US005823625A

United States Patent [19]

Holmes

[11] Patent Number: 5,823,625

[45] Date of Patent: Oct. 20, 1998

[54] ARM AND BACK ATTACHMENT

[75] Inventor: Lester Holmes, South Haven, Miss.

[73] Assignee: Chromcraft/Revington Company, Senatobia, Miss.

[21] Appl. No.: 871,017

[22] Filed: Jun. 9, 1997

[51] Int. Cl.[6] ..... A47C 5/04

[52] U.S. Cl. ..... 297/411.44; 297/411.28

[58] Field of Search ..... 297/411.28, 411.44, 297/411.29, 411.27, 411.26, 411.25, 411.24, 411.23, 440.1, 452.57; 403/353

[56] References Cited

U.S. PATENT DOCUMENTS 2,658,555 11/1953 Barker .
3,883,175 5/1975 Rodaway .
4,118,069 10/1978 Hunter .
5,056,868 10/1991 Beck .
5,318,346 6/1994 Roossien et al. .

FOREIGN PATENT DOCUMENTS 721140 12/1954 United Kingdom .

*Primary Examiner*—Milton Nelson, Jr.
*Attorney, Agent, or Firm*—Wolf, Greenfield & Sacks, P.C.

[57] ABSTRACT

A totally concealed connection is made between the arm of a chair and the backrest by an L-shaped connecting pin which has one end screwed into a threaded boss on the inside edge of the arm and its other end inserted through an opening in a clip secured to the stiff core of the backrest. The angular relationship of the two parts of the pin retains the arm in a fixed position with respect to the backrest when the arm is also connected to the chair at a location remote from the pin.

23 Claims, 3 Drawing Sheets

ARM AND BACK ATTACHMENT

This invention relates to furniture construction and more particular to a system for attaching an arm to the backrest of an upholstered chair.

The principal object of the present invention is to achieve a totally concealed connection between arms and backrest of an upholstered chair with uncomplicated and easy to use hardware so are not to adversely affect the cost of manufacturing of the chair.

In accordance with the present invention, the backrest is provided with a semi-rigid core made of plywood or similar material covered by foam such as low density polyurethane. Each side edge of the core is routed and caries a U-shaped clip whose bite is disposed in the routed area so as to lie in the plane of the core edge. The bite has an opening facing away from the core edge. The point on the edge of each arm which is to engage the edge of the backrest has an opening into which one end of a connecting pin is threaded, and the other or free end of the pin is bent at an angle to the threaded end so that it can extend through the opening in the bite and engage the inner face thereof when the arm is placed in the operative position with respect to the backrest. Another point of each arm is also secured to the chair, preferably the seat, and the two connections for each arm rigidly fix them with respect to the backrest and seat of the chair.

These and other objects and features of the present invention will be better understood and appreciated from the following detailed description of the preferred embodiment thereof, read in connection with the accompanying drawing.

BRIEF FIGURE DESCRIPTION

DETAILED DESCRIPTION

Figure 1:
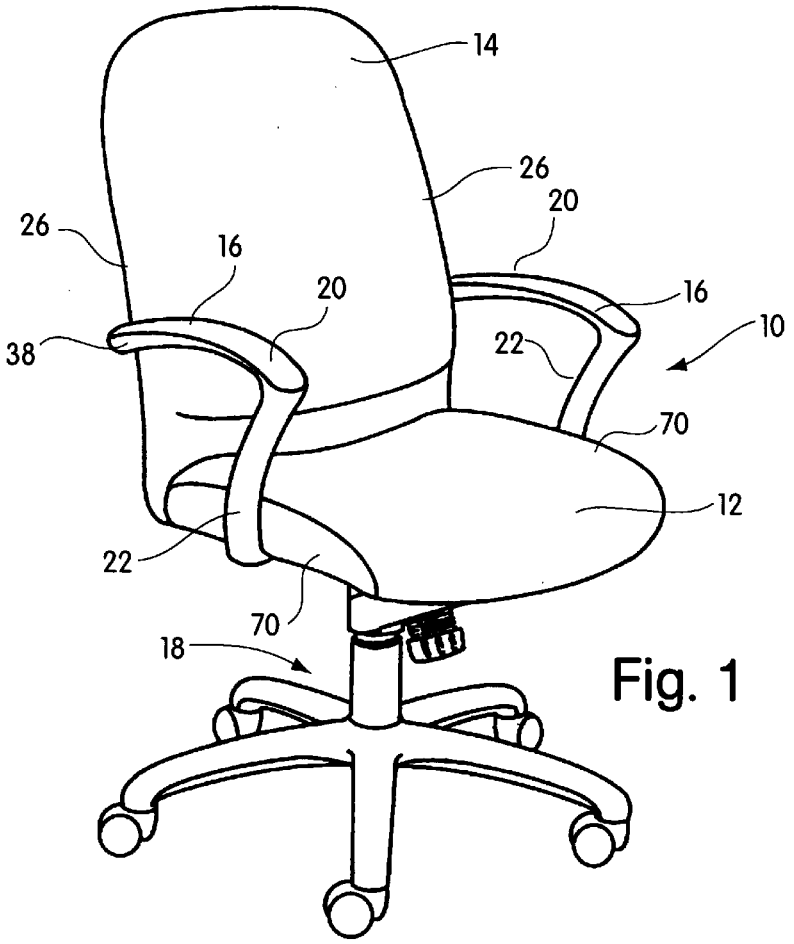
FIG. 1 is a perspective view of a chair having arms mounted to the chair assembly in accordance with this invention.
Figure 2:
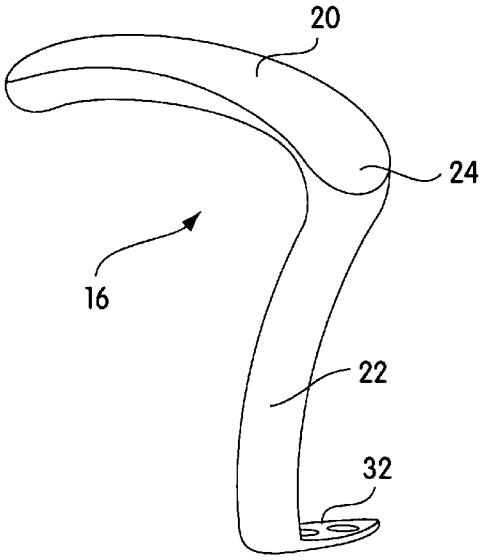
FIGS. 2 and 3 are inside and outside perspective views, respectively, of the right arm of the chair of FIG. 1.
Figure 3:
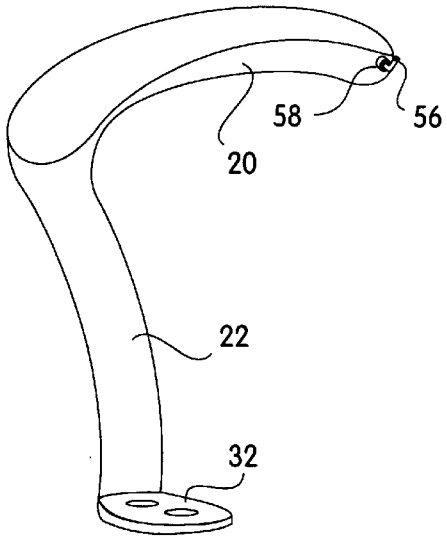

In FIG. 1 a chair 10 is shown having a seat 12, backrest 14, arms 16 and a pedestal 18. The present invention is particularly directed to the manner in which the arms 16 are connected to the backrest 14. The application of the invention is not confined to pedestal chairs or to chairs having a particular design or configuration of backrest or seat but rather has general application to all types and styles of chairs having arms that are mounted to the backrest.

In the embodiment of chair illustrated, the arms 16 are generally L-shaped, each having an upper substantially horizontal portion 20 and a lower downwardly extending substantially vertical portion 22 connected together at the front corner 24. The rear end of the upper portion 20 of each arm 16 is connected to a side edge 26 of the backrest 14 while the bottom end of lower portion 22 of each is connected to the seat 12. In particular, the bottom end of each lower portion of the arms is connected to the underside

Figure 7:
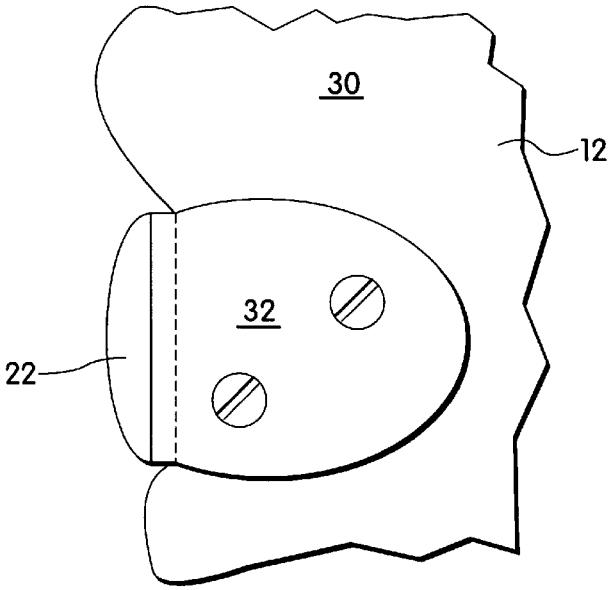
FIG. 7 is a fragmentary bottom plan view of the chair showing how the bottom of the lower portion of the arm is attached to the seat.

30 of the seat as shown in FIG. 7. For that purpose, the lower end of the vertical portion 22 carries a horizontal flange 32 that is screwed to the underside seat.

Figure 4:
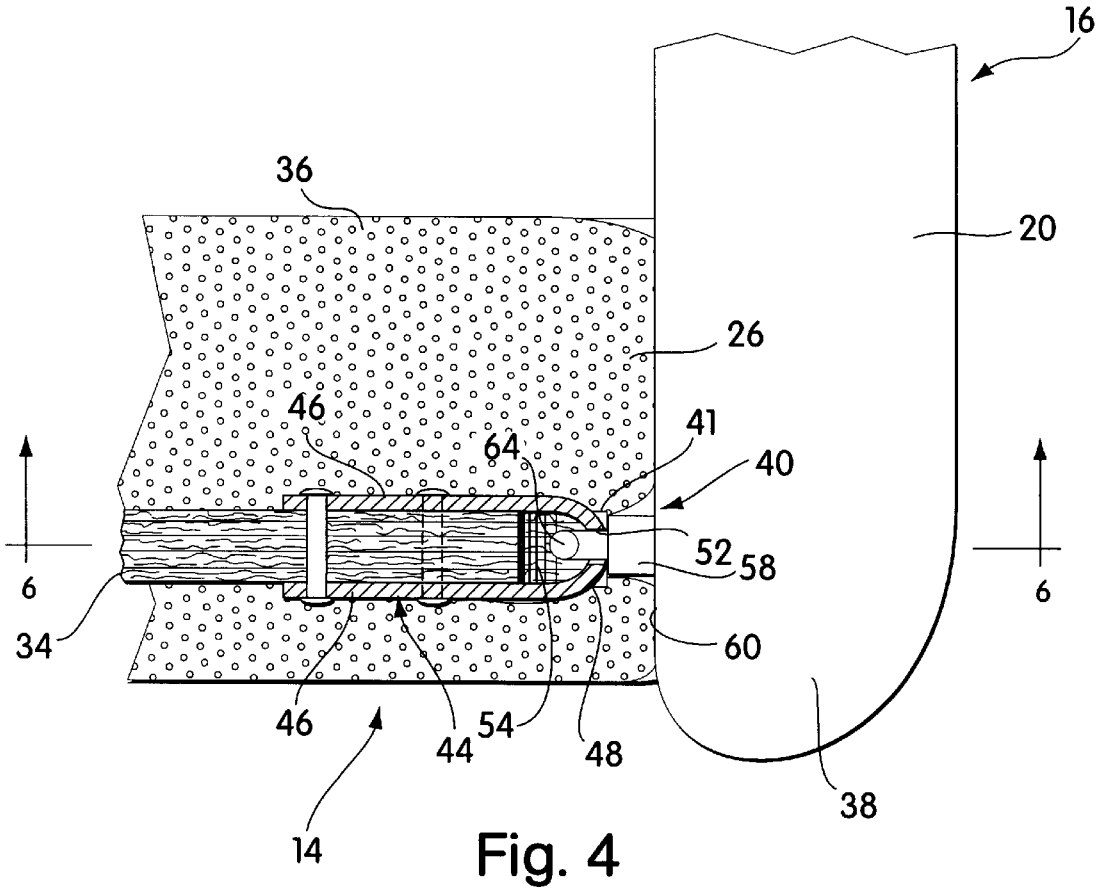
FIG. 4 is a fragmentary horizontal cross-sectional view of the chair showing the attachment of the rear of the upper portion of the arm to the backrest.
Figure 5:
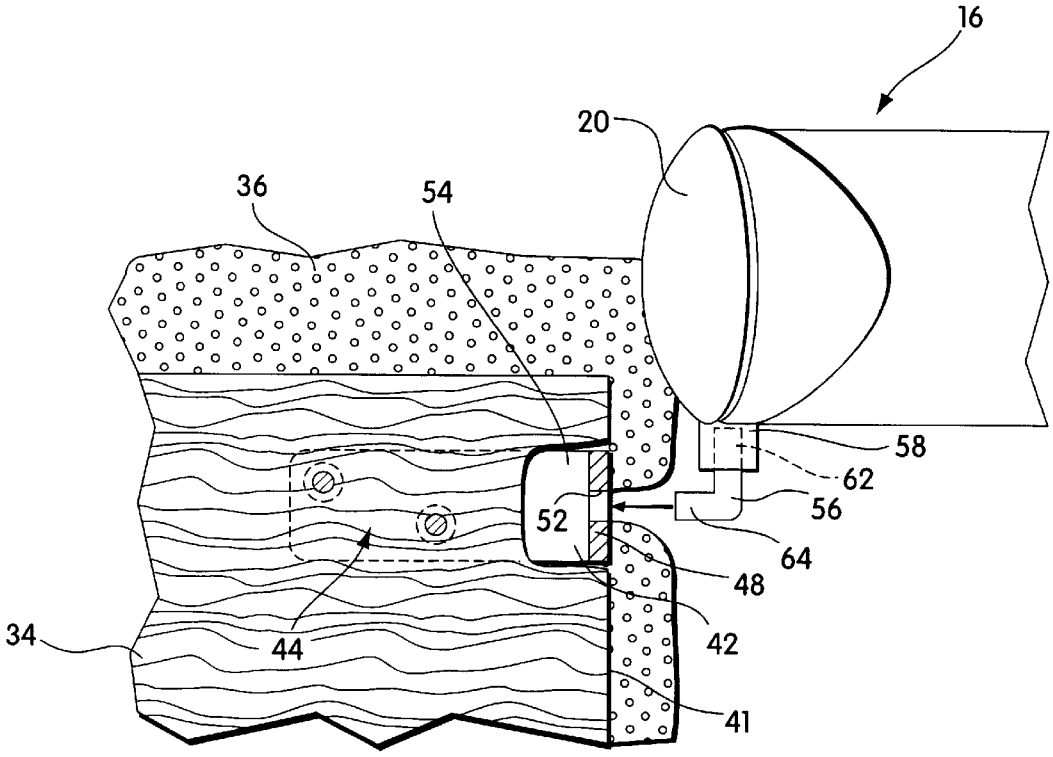
FIGS. 5 and 6 are cross-sectional views taken on section line 6—6 in FIG. 4 and suggesting sequentially how the arm is attached to the backrest.
Figure 6:
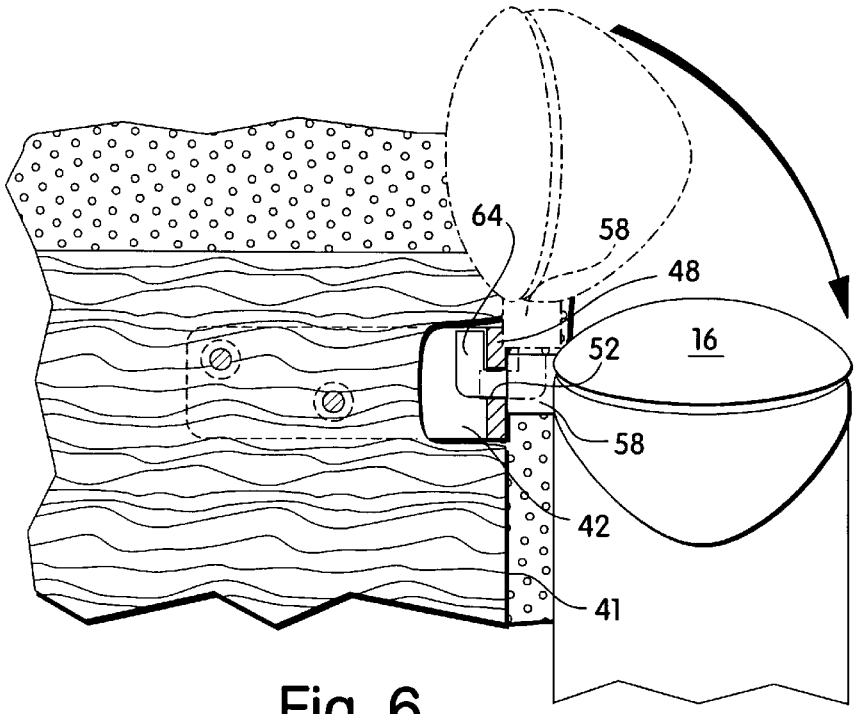

The backrest 14 of the chair as shown in FIGS. 4–6 has a core 34 typically made of plywood contoured to provide comfortable and healthful support for the back of the chair occupant. While plywood is highly functional for that purpose, other materials may be used such as molded plastic, etc. that have the right flexibility and strength to function in this setting. The core in turn is covered by a substantial layer of foam material 36, typically a low density polyurethane, which provides appropriate cushioning for maximum comfort. The seat is similarly cushioned, and both are suitably upholstered with fabric, leather or other material. The rear end 38 of each of the upper portions 20 of the arms 16 is connected to the backrest 14 by the hardware 40 described in detail below. In the following description the connection for one arm is described but it is to be appreciated that each arm 16 is connected to its respective side 26 of the backrest 14 in the same way and that the parts are duplicated on each side.

In FIGS. 4–6 side edge 41 of the core is shown routed at 42, and a clothespin or U-shaped clip 44 is mounted in the routed area with the arms 46 of the clip lying on the front and rear surfaces of the core. The arms 46 are riveted together through the core 34. The bite 48 of the clip lies in the plane of the edge 41 of the core and has a circular opening 52 at its approximate center. Behind the opening 52 and within the clip is a chamber 54 which receives the connecting pin 56 mounted on the arm 16 as described in greater detail below.

The arm 16 typically is insert molded with a rigid metal core and is formed with a fastener in the form of an internally threaded boss 58 at its inner edge 60 at the rear end 38 of the upper portion 20. The boss 58 may extend slightly out of the plane of the inner edge 60 of the arm. The connecting pin 56 has a threaded stem 62 which screws into the boss 58 and a portion 64 which is substantially at right angles to the stem and which is unthreaded but sized to fit into the circular opening 52 in the bite 48 of the clip 44. When positioned in the opening 52, the portion 64 lies behind the bite 48 in the chamber 54 and preferably extends upwardly in a generally vertical direction. The threaded stem 62 is normally bottomed out in the threaded boss 58 and in that position the stem 62 spaces the portion 64 a short distance from the outer surface of the bite 48 so as to accommodate the thickness of the bite of the clip. When mounted in that fashion, the foam padding 36 covering the core 34 of the backrest is compressed so as to form a neat and finished appearance at the connection without a gap between the arm and the backrest 14. Therefore, the connection is totally concealed without any visible hardware with which the connection is made. The bottom end of the lower portion 22 of the arm bears against and compresses the foam padding at the edge 70 of the seat when the lower portion is screwed or otherwise attached to the seat as shown in FIG. 7 so that no gap is present between the arm and the seat.

To mount the arm 16 on the previously assembled seat and backrest, the connecting pin 56 is screwed into the boss 58 and preferably the portion 64 of the pin extends generally perpendicular and in the direction of the top side of the upper portion 20 of the arm. The arm 16 is turned horizontally as suggested in FIG. 5 so as to align the pin portion 64 with the opening 52 in the bite of the clip 44 on the core 34 and disposed within the foam 36 covering the back. After the portion 64 of the pin is inserted through the opening 52, the arm is rotated as suggested in FIG. 6 so as to place the upper surface of the arm 16 in the operative position with respect to the backrest 14. The arm may also be turned slightly on the axis of the threaded portion 62 of the pin so as to place the flange 32 on the bottom of the lower portion 22 of the arm in position to be attached to the underside 30 of the seat as in FIG. 7. When the flange 32 is secured to the seat, the arm 12 is rigidly fixed to the seat and backrest and cannot move relative to them without loosening the connection between the seat and arm. Both arms are attached to the chair assembly in that fashion.

From the foregoing description, it will be appreciated that the connection between the arms and backrest are totally concealed. There is no visible means of attachment as all the hardware is covered by the foam cushion and upholstery.

Having described the invention in detail, those skilled in the art will appreciate that numerous variations may be made of the invention without departing from its spirit. Therefore, the scope of the inventions is not to be limited to the specific embodiment illustrated and described, but rather its scope is to be determined by the appended claims and their equivalents.

I claim:

1. A chair comprising a seat and backrest, said backrest having side edges, an arm having an upper portion extending forwardly from the backrest and a downwardly extending portion connected to the seat, a connection between the upper portion of the arm and the backrest including a clip mounted on the backrest and having an opening therein, a fastener connected to the arm and having a threaded opening therein, said fastener being disposed adjacent the backrest when the arm is connected in its operative position to the backrest and seat, and a connecting member having a first portion threaded into the threaded opening in the fastener and having a second portion disposed at an angle to the first portion of the connecting member and extending into the opening in the clip to join the arm to the backrest.

2. A chair as defined in claim 1 wherein the second portion of the connecting member forms an angle with the first portion of the member of approximately 90°.

3. A chair as defined in claim 1 wherein cushion material and upholstery cover the backrest, and the clips are covered by the cushion material.

4. A chair as defined in claim 3 wherein the second portion of the connecting member forms an angle with the first portion of the member of approximately 90°.

5. A chair as defined in claim 3 wherein the first portions of the connecting members are threaded into the openings in the fasteners.

6. A chair as defined in claim 5 wherein the first portions of each connecting member are substantially perpendicular to the second portions of their respective connecting members.

7. A chair comprising a backrest, seat and a pair of arms, one arm on each side of the chair;

said backrest, seat and arms comprising a body support, each of said arms having a section connected to the backrest;

the backrest having a rigid core with side edges, the connection between each of the arms and the backrest including a pair of clips, one for each arm mounted adjacent the side edges of the core on the backrest and each clip having an opening therein facing outwardly from a side edge of the core in the direction of an arm; a fastener mounted to each arm and disposed adjacent one of the clips on the backrest when the arms are connected in operative positions to the backrest, and connecting members having first portions mounted to the fasteners and second portions disposed at an angle to the first portions and extending into the openings in the clip to join the arms to the backrest.

8. A chair as defined in claim 7 wherein the clips are mounted on the edges and the openings on the clips face outwardly from the side edges in the direction of the arms.

9. A chair comprising a seat and backrest, said backrest having side edges and a rigid core with inner and outer faces, an arm having an upper portion extending forwardly from the backrest and a downwardly extending portion connected to the seat, the connection between the upper portion of the arm and the backrest including a substantially U-shaped clip having a pair of arms engaging the faces of the core of the backrest and having an opening therein, a fastener on the arm and disposed adjacent the backrest when the arm is connected in its operative position to the backrest and seat, and a connecting member having a first portion mounted to the fastener and having a second portion disposed at an angle to the first portion of the connecting member and extending into the opening in the clip to join the arm to the backrest.

10. A chair as defined in claim 9 wherein the clip has a bite that joins the arms thereof and with the bite disposed closely adjacent the side edge of the core, and the opening in the clip being disposed in the bite.

11. A chair as defined in claim 10 wherein the fastener has an opening therein which is disposed closely adjacent to the opening in the clip when the arm is connected in its operative position to the backrest and seat.

12. A chair as defined in claim 11 wherein the first portion of the connecting member extends into the opening in the fastener.

13. A chair as defined in claim 12 wherein the opening in the fastener is threaded and the connecting member screws into the threaded opening in the connecting member.

14. A chair as defined in claim 13 wherein the second portion of the connecting member forms an angle with the first portion of the member of approximately 90°.

15. A chair as defined in claim 9 wherein cushion material and upholstery cover the backrest, and the clips are covered by the cushion material.

16. A chair as defined in claim 15 wherein the clip has a bite that joins the arms thereof and with the bite disposed closely adjacent the side edge of the core, and the opening in the clip being disposed in the bite.

17. A chair as defined in claim 16 wherein the fastener has an opening therein which is disposed closely adjacent to the opening in the clip when the arm is connected in its operative position to the backrest and seat.

18. A chair as defined in claim 17 wherein the first portion of the connecting member extends into the opening in the fastener.

19. A chair as defined in claim 18 wherein the opening in the fastener is threaded and the connecting member screws into the threaded opening in the connecting member.

20. A chair comprising a backrest, seat and a pair of arms, one arm on each side of the chair;

said backrest and seat comprising a body support, each of said arms having a section connected to the backrest, the connection between each of the arms and the backrest including a pair of clips, one for each arm mounted on the backrest and each having an opening therein, a fastener mounted to each arm and disposed adjacent one of the clips on the backrest when the arms are connected in operative positions to the backrest, said fasteners each having an opening closely adjacent the opening in the adjacent clip, and connecting members having first portions mounted in the openings in the fasteners and second portions disposed at an angle to the first portions and extending into the openings in the clip to join the arms to the backrest.

21. A chair as defined in claim 20 wherein the arms have second sections secured to the seat.

22. A chair as defined in claim 20 wherein the arms have second sections secured to the body support at a location spaced from the connections of the arms to the backrest.

23. A chair as defined in claim 20 wherein cushion material and upholstery cover the backrest, and the clips are covered by the cushion material.

* * * * *